US007146926B1

(12) United States Patent
Yang

(10) Patent No.: US 7,146,926 B1
(45) Date of Patent: Dec. 12, 2006

(54) TIE-DOWN KIT FOR SUPPORTING BOAT COVER

(75) Inventor: Ming-Shun Yang, Taipei (TW)

(73) Assignee: Formosa Saint Jose Corp., Taipei (TW)

( * ) Notice: Subject to any disclaimer, the term of this patent is extended or adjusted under 35 U.S.C. 154(b) by 0 days.

(21) Appl. No.: 11/258,045

(22) Filed: Oct. 26, 2005

(51) Int. Cl.
*B63B 17/00* (2006.01)

(52) U.S. Cl. ..... 114/361

(58) Field of Classification Search ..... 114/361, 114/364; 135/87, 114, 142
See application file for complete search history.

(56) References Cited

U.S. PATENT DOCUMENTS 872,088 A * 11/1907 Sherman ..... 114/361
3,106,218 A * 10/1963 Wright ..... 114/361
3,106,931 A * 10/1963 Cooper ..... 114/361
5,228,408 A * 7/1993 Jannausch ..... 114/361
5,479,872 A * 1/1996 Hulett ..... 114/361
6,308,653 B1 * 10/2001 Geraci ..... 114/361

* cited by examiner

*Primary Examiner*—Lars A. Olson
(74) *Attorney, Agent, or Firm*—Troxell Law Office, PLLC

(57) ABSTRACT

A tie-down kit for supporting a boat cover is primarily composed of a disk, a length adjustable pole and a rope. The disk bottom is provided with a flange having a hole, and two cross grooves on the top. The top end of the length adjustable pole is inserted into the hole of the flange, while the bottom end of the length adjustable pole has a base. One end of the rope goes through the two grooves at the top of the disk. Thereby, with the length adjustable pole disposed in the boat for adjusting an appropriate height, and the rope bound around the bow and stern of the boat, when the boat cover is mounted on the hull, it can be perfectly supported.

2 Claims, 8 Drawing Sheets

TIE-DOWN KIT FOR SUPPORTING BOAT COVER

BACKGROUND OF THE INVENTION (a) Field of the Invention

The present invention relates to a tie-down kit for supporting a boat cover, particularly to one that can sustain a boat cover, such that the boat cover would not sink and accumulate rain or rubbish.

(b) Background of the Invention

Boat covers are generally used to protect the boats from chap or damage due to dust or sunburn. As such, a boat would be covered by a boat cover for protection purposes when it is not in use.

FIG. 8 shows a conventional boat cover mounted on a boat. In view of the fact that the boat cover a is made of a soft fabric, and that the windscreen of the boat b would present a protrusion out of the hull, while the cabin and the deck would present a recession, when the boat cover a is mounted on the boat b, the surface of the boat cover a would form many recessions c, thus accumulating rain or trash. When the user lifts the boat cover for using the boat, the rain accumulated on the boat cover will splash the user or flow into the cabin. Besides, the boat cover will become smelly after being folded under a wet status.

A further design is composed of four ropes and a supporting pole. One end of the four ropes is fastened to the top of the supporting pole, and the other end of the ropes is tied on the four corners of the boat. And then the boat cover is mounted on the tie-down ropes. Although the boat cover made of soft fabrics or canvas can be supported thereby, the four ropes might not easily tied evenly and firmly, and it is likely that more than one person is required for processing the tie-down work.

In view of the above, the inventor has positively researched and therefore disclosed the present invention for firmly supporting the boat cover without occurring any recession to accumulate the rain.

SUMMARY OF THE INVENTION

The primary object of the invention is to provide a tie-down unit for supporting a boat cover, which can efficiently support the boat cover and prevent the boat cover from partially recessing, thereby avoiding accumulation of rain or trash on the boat cover.

The secondary object of the invention is to provide a tie-down unit for supporting a boat cover, which can allow the user to easily operate and set up the boat cover without any accumulation of rain on the boat cover.

To obtain the above objects, the invention discloses a tie-down unit for supporting a boat cover, which is primarily composed of a disk, a length adjustable pole and a rope. The disk bottom is provided with a flange having a hole, and two cross grooves on the top. A shield is provided at an appropriate position of the top of each groove. The top end of the length adjustable pole is inserted into the hole of the flange, while the bottom end of the length adjustable pole has a base. Thereby, with the length adjustable pole disposed in the boat for adjusting an appropriate height, and the rope bound around the bow and stern of the boat, when the boat cover is mounted on the hull, it can be perfectly supported. A stopper can be further provided, such that one end of the rope can be held at the stopper, and the other end of the rope goes through the grooves and the exit at the bottom of the stopper for holding purposes. Accordingly, the user can simply pull the rope at the stopper end to instantly tie down the rope.

To completely appreciate these and other objects of the present invention as well as the invention itself, all of which will become apparent to those skilled in the art, the following detailed description of the invention and the claims should be read in conjunction with the accompanying drawings.

DETAILED DESCRIPTION OF THE PREFERRED EMBODIMENTS

Figure 1:
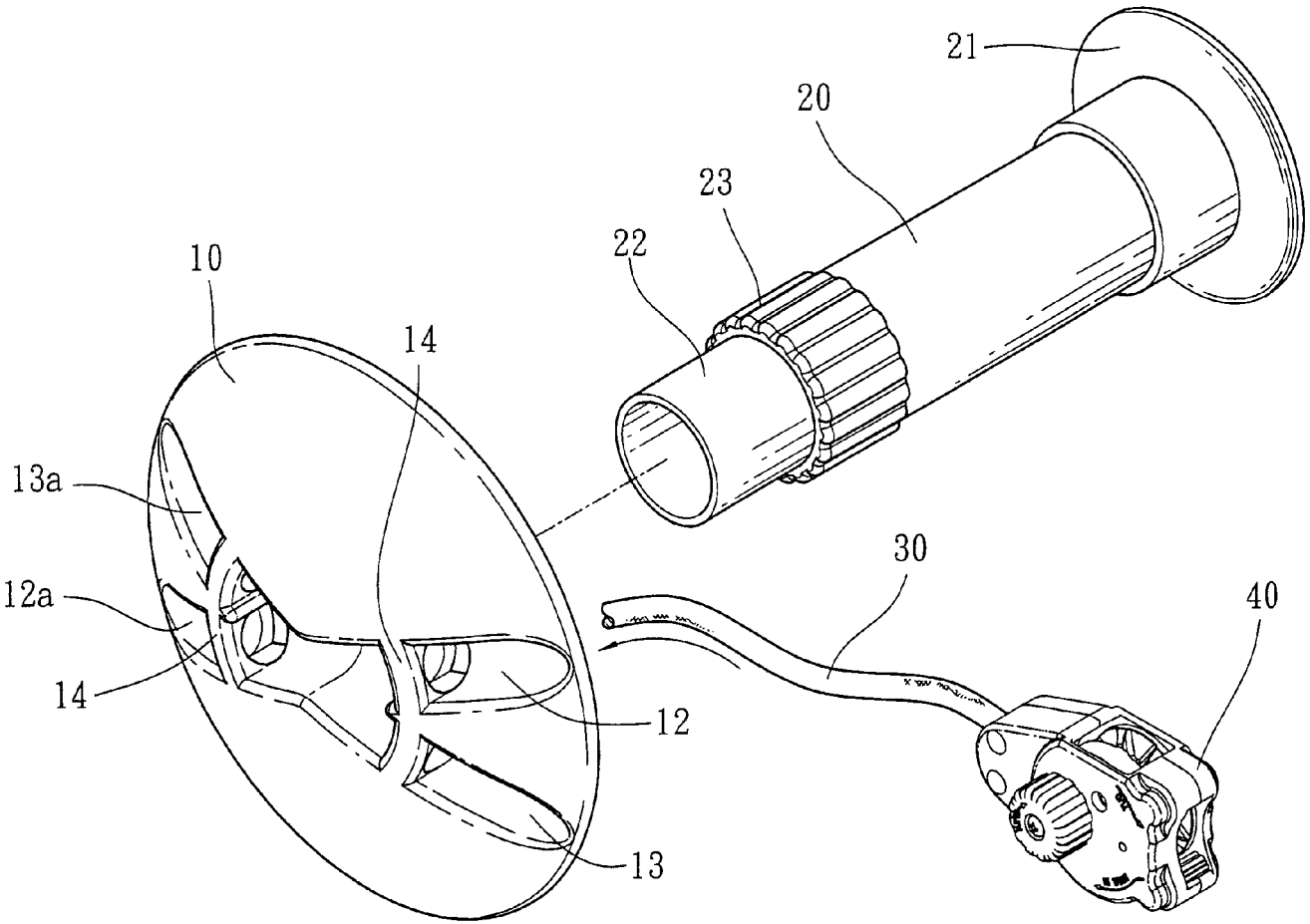
FIG. 1 is an exploded view of the present invention.
Figure 2:
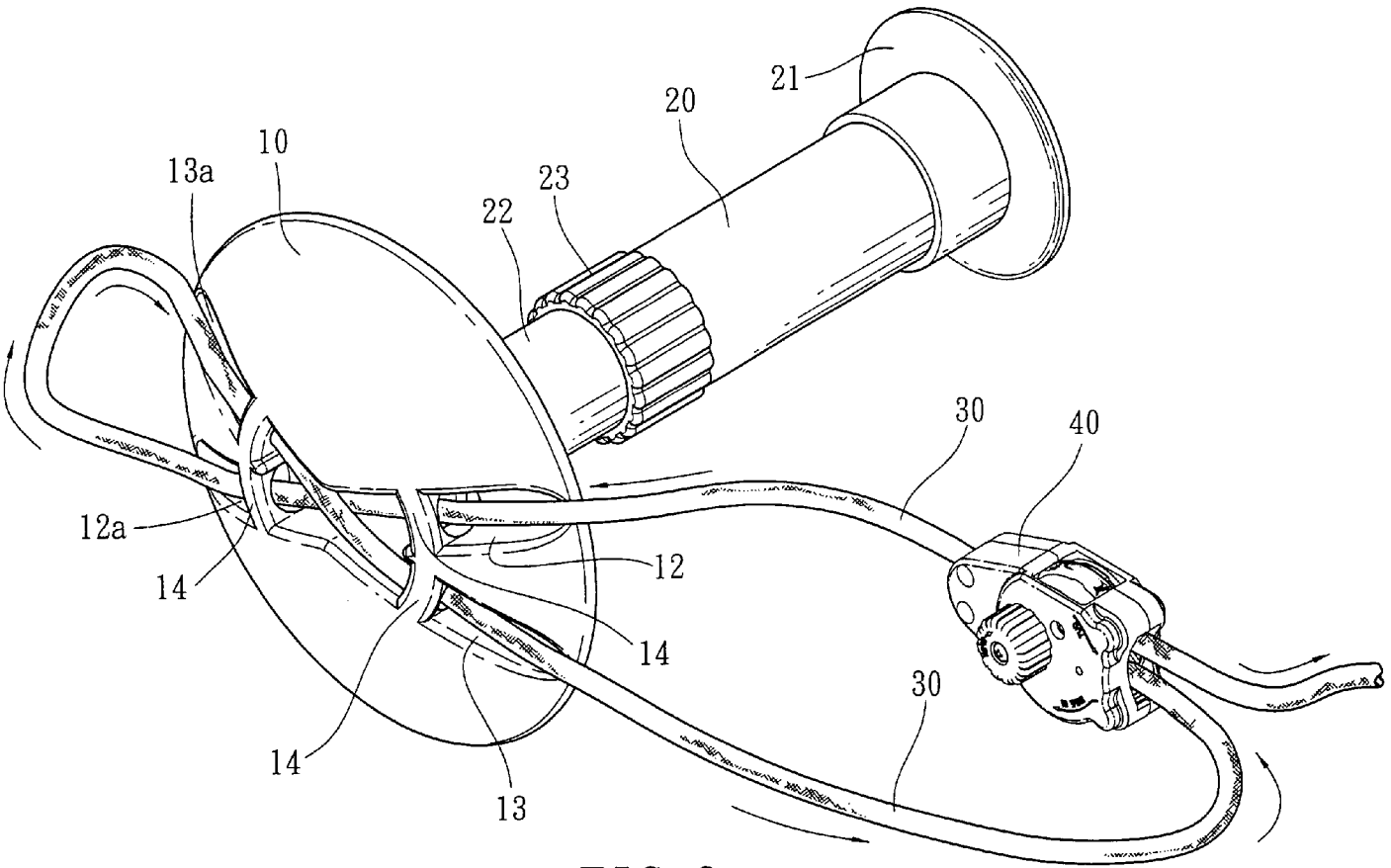
FIG. 2 is a perspective view of the invention.
Figure 3:
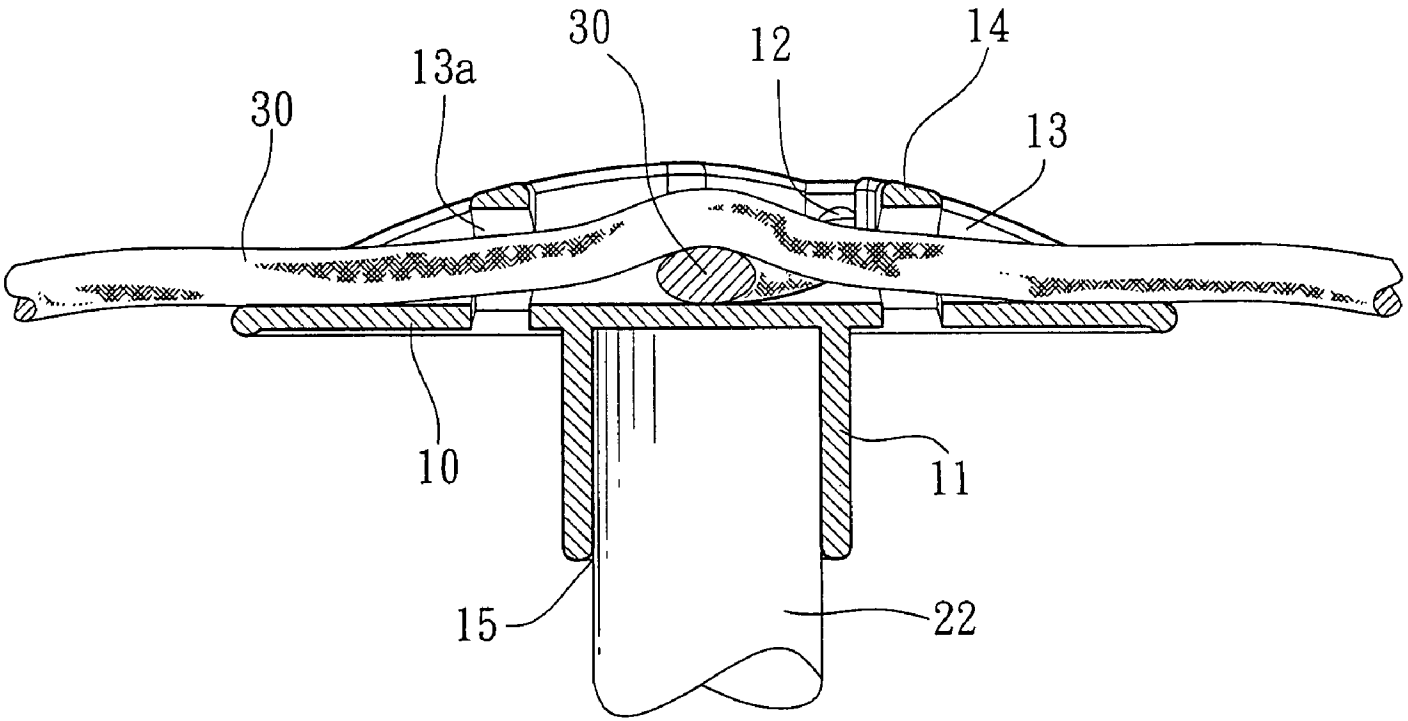
FIG. 3 is a partially exploded view of the invention.

Referring to FIGS. 1 to 3, the main embodiment of the present invention is primarily composed of a disk 10, a length adjustable pole 20, a rope 30 and a stopper 40. The disk 10 bottom is provided with a flange 11 (as shown in FIG. 3) which is provided with two cross grooves 12, 13 on the top. A shield 14 is provided at the top of each of the grooves 12, 13, while a hole 15 is formed at the center of the flange 11 (as shown in FIG. 3).

The bottom end of the length adjustable pole 20 has a base 21 of a relatively greater size, while the top end of the length adjustable pole 20 has front pole 22 which is inserted into the hole 15 of the flange 11 at the bottom disk 10 for positioning purposes. When the length adjustable pole 20 is adjusted to a length that is also the distance the disk 10 keeps away from the ground. Furthermore, by way of a rugged portion 23 provided on the length adjustable pole 20, the user may hold the rugged portion 23 to ease rotation of the front pole 22 for fastening the length adjustable pole 20 and fixing it to a length.

Figure 4:
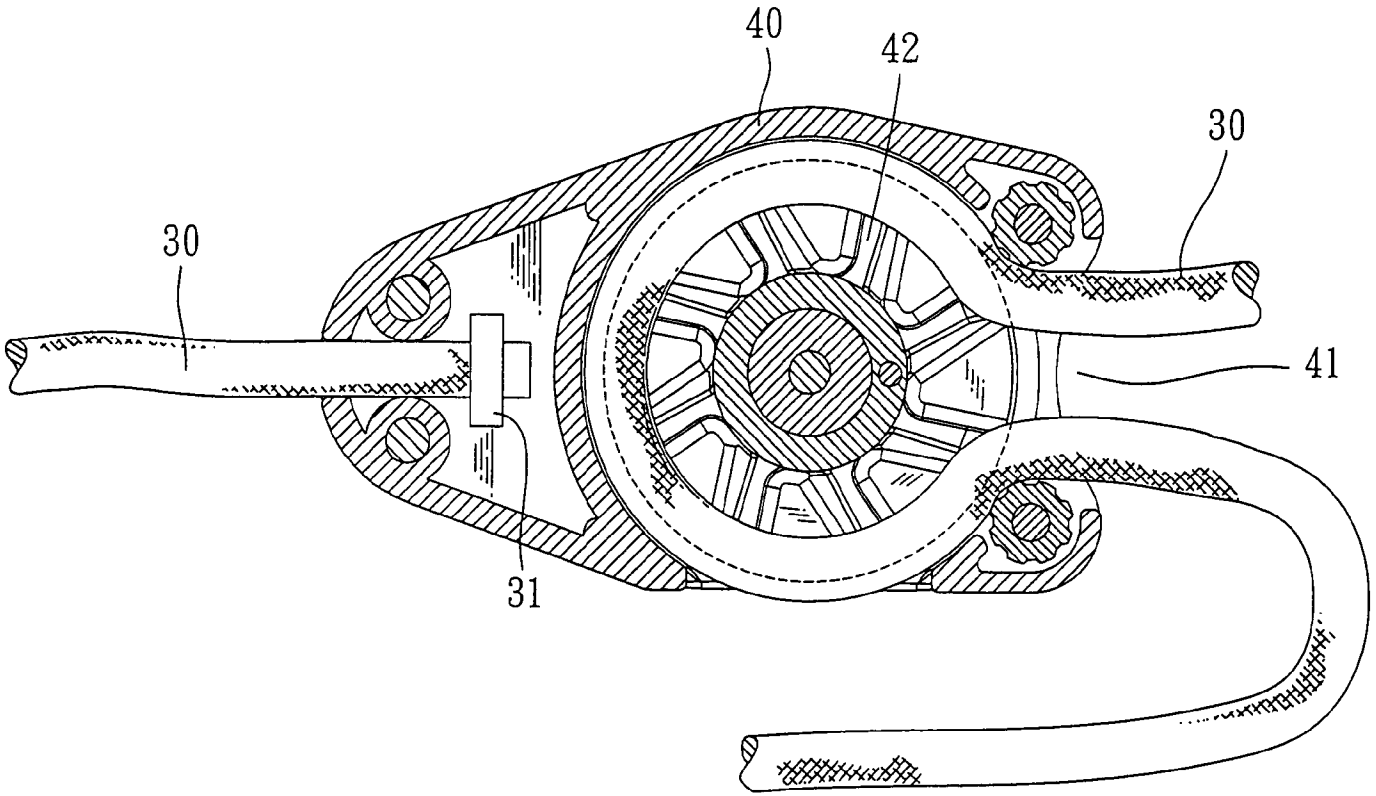
FIG. 4 is a cross-sectional view showing that the rope goes into the stopper.

As shown in FIGS. 2 and 4, one end of the rope 30 is held to the front end of the stopper 40, while the other end of the rope 30 goes through the groove 12 at the top of the disk 10, goes out of the groove 12 a at the opposite side, then goes through the groove 13*a* at the distal end, then goes out of the groove 13 at the adjacent end, and finally goes through the exist 41 at the bottom of the stopper 40 and goes around the roller disk 42.

FIG. 4 shows the combination of the rope 30 and the stopper 40. As shown, one end of the rope 30 is fastened to an end element 31 fixed on the stopper 40, whereas the other end of the rope 30 goes through the exist 41 of the stopper 40 and goes clockwise around the roller disk 42 which is interiorly provided with unidirectional ratchets and a locking bolt for unidirectionally moving the rope 30, thereby the tie-down kit can be firmly fastened to the hull 50 for supporting the boat cover.

Figure 5:
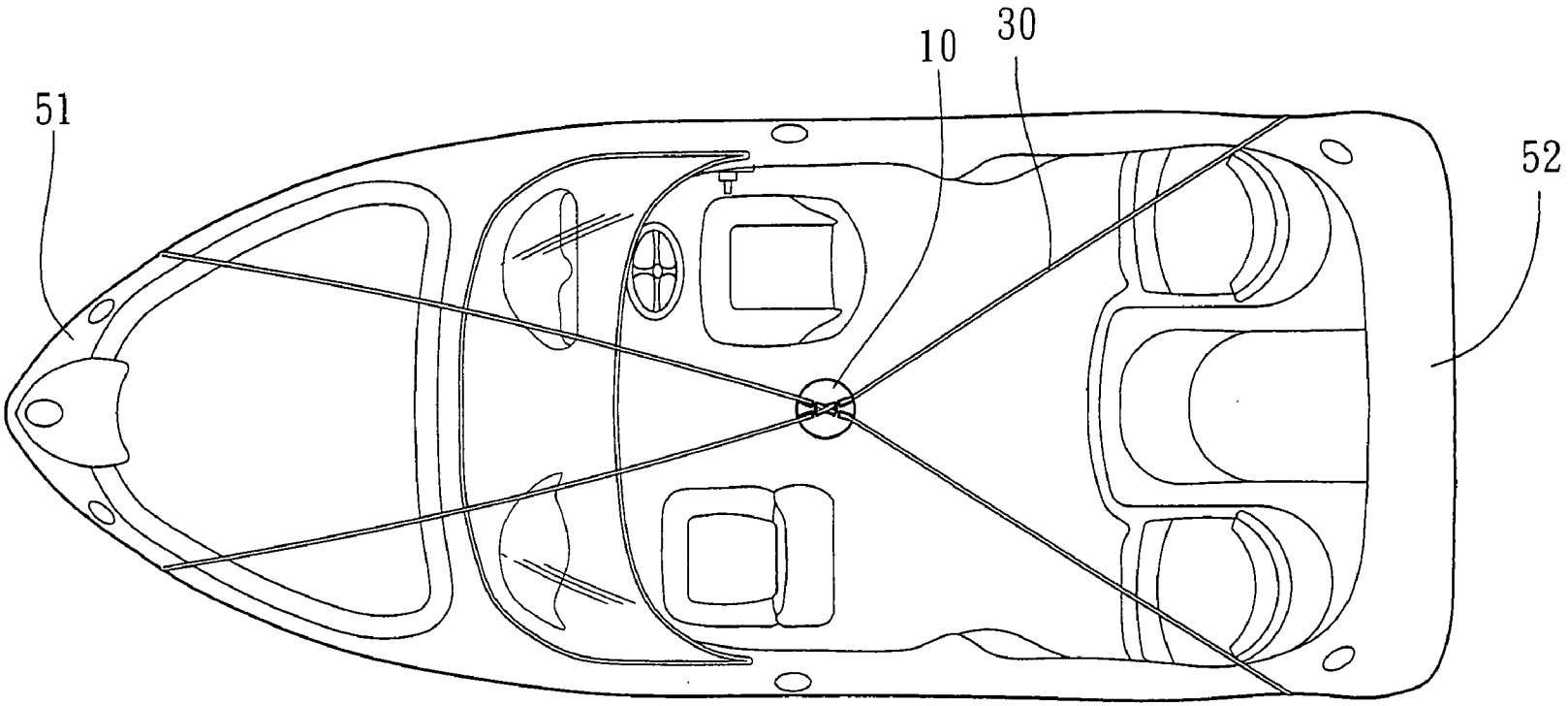
FIG. 5 is a perspective view showing installation of the rope around the boat.
Figure 6:
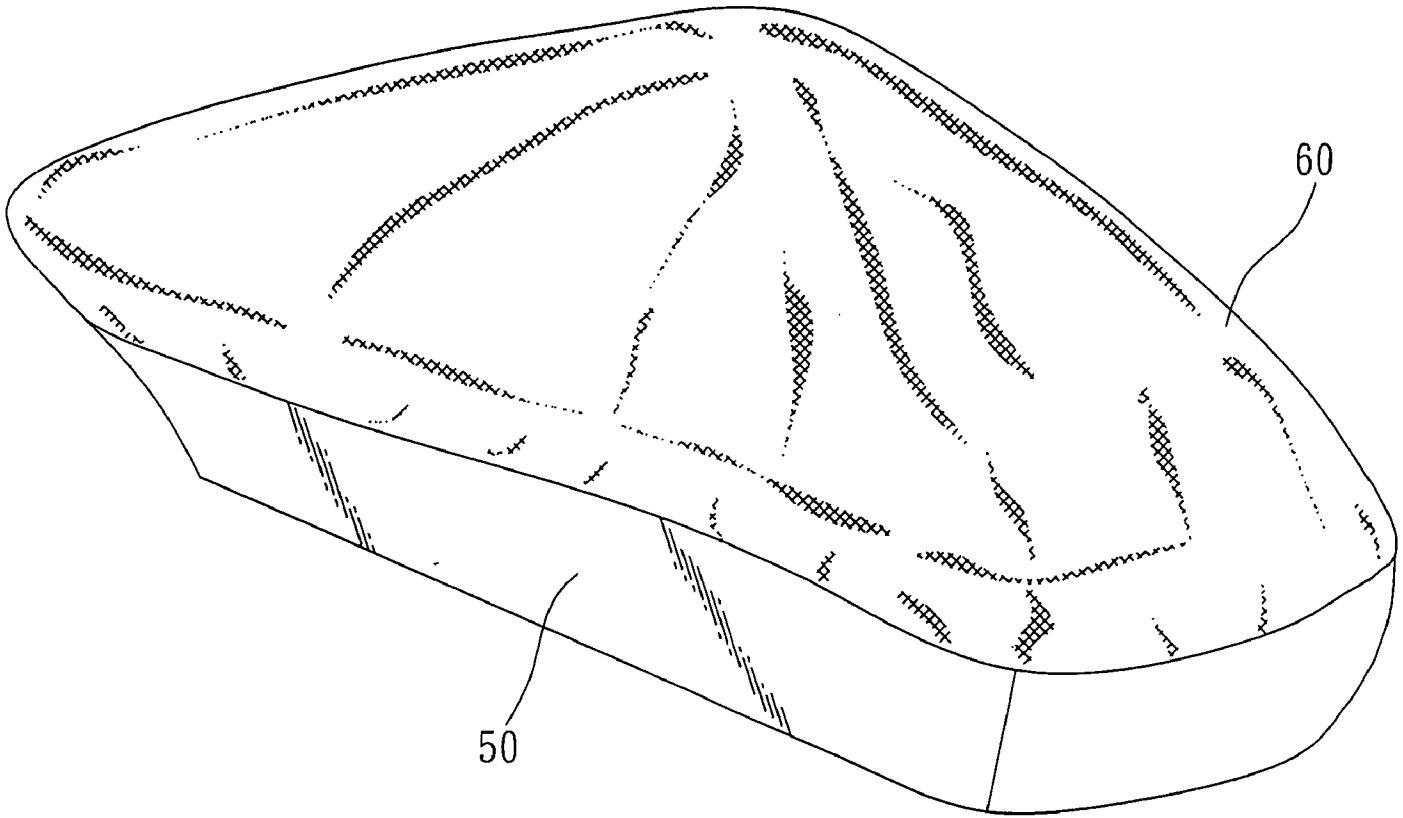
FIG. 6 shows the use status of the present invention.

As shown in FIGS. 5 and 6, when installing the invention, the length adjustable pole 20 must firstly be disposed in the hull 50 with the disk 10 connected to the rear end thereof, and then the length adjustable pole 20 along with the disk 10 is adjusted to a desired and fixed height. After the rope 30 loop goes around the bow 51 and the stern 52, it is tied down to form an adjustable supporter for supporting the boat cover. When the boat cover 60 is mounted on the hull 50, it will be perfectly supported without occurring any recession to accumulate the rain on the surface of the boat cover 60.

Figure 7:
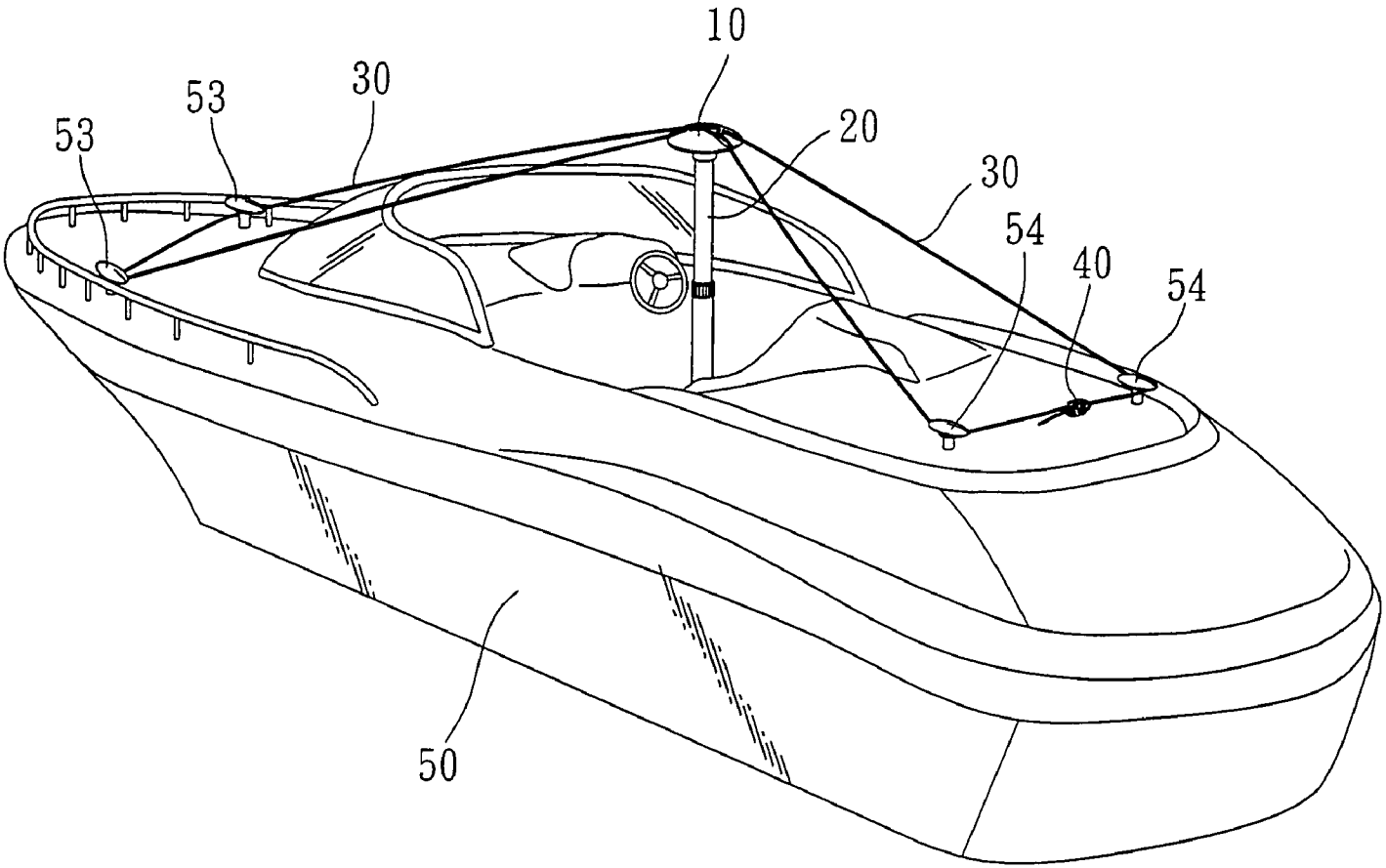
FIG. 7 is a perspective view showing another format of installation of the rope around the boat.
Figure 8:
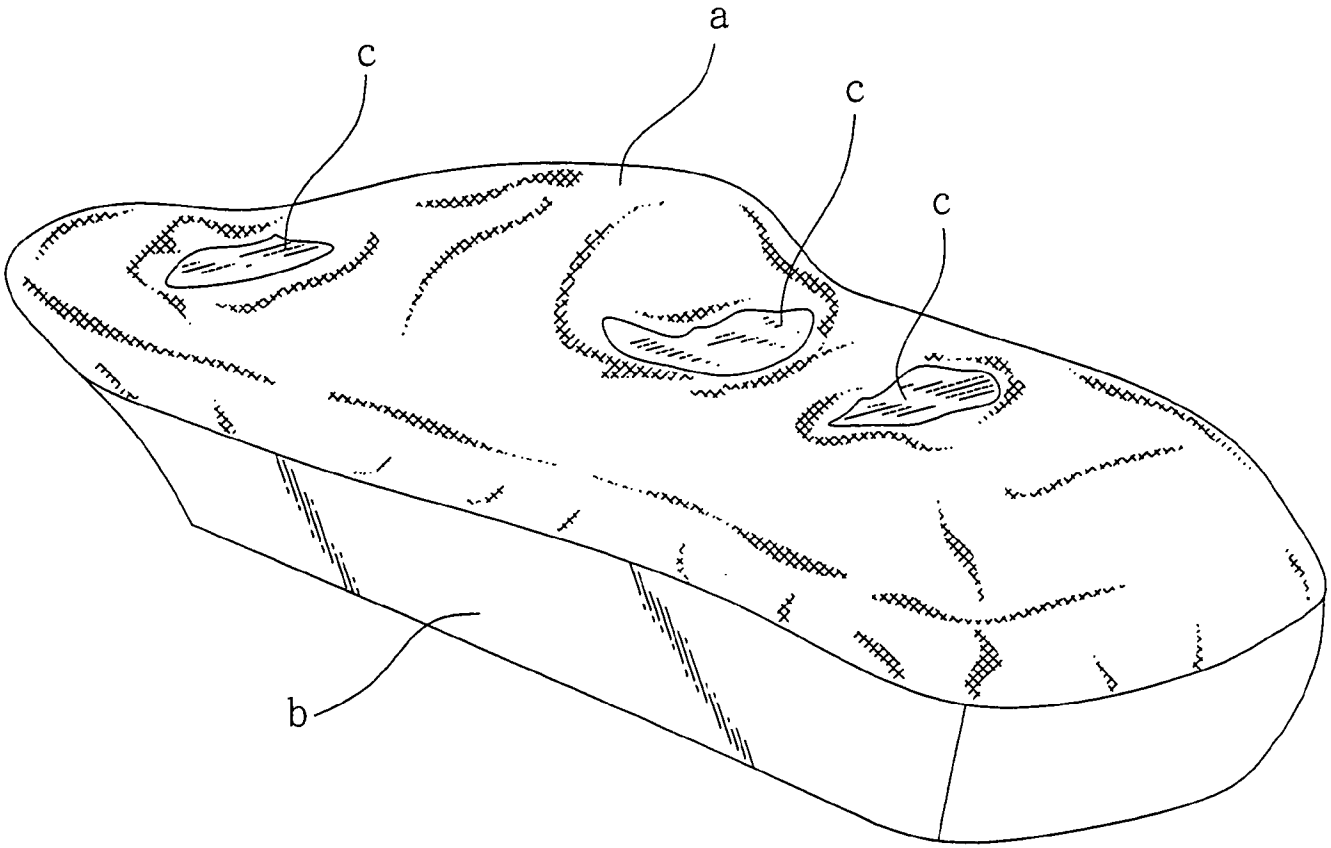
FIG. 8 PRIOR ART
FIG. 8 shows the use status of the prior art.

FIG. 7 shows another embodiment on tie down the rope 30. One end of the rope 30 is held on the stopper 40, while the other end of the rope 30 goes through the groove 12 on the top of the disk 10 and goes around the holding piles 53 at the two sides of the bow 51, and then goes through the groove 13*a* and goes around the holding piles 54 at the two sides of the stern 52, thereby when the user pulls the rope 30, the whole tie-down would be tugged to draw tight and firm. The rope 30 can be knotted to fasten. In the shown embodiment, the rope 30 is fastened after going through the exist 41 under the stopper 40 and going around the interior roller disk 41. By way of the unidirectional braking effect of the stopper 40, the rope 30 can be firmly tied down.

It's worthy a mention that although the rope 30 as shown is installed with a stopper 40, the stopper 40 can be spared in other embodiments. After the rope 30 goes through the disk 10 and tied around the bow 50 and the stern 52, it can be knotted, thereby serving as a supporter for the boat cover 60.

Concluded above, the tie-down kit for supporting a boat cover according to the invention is simply equipped, and can serve as a perfect support without occurring any recession on the surface of the boat cover to accumulate the rain.

While certain novel features of this invention have been shown and described and are pointed out in the annexed Claims, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A tie-down kit for supporting a boat cover, comprising a disk, a length adjustable pole and a rope, wherein, a disk bottom is provided with a flange which has a central hole on the bottom and two grooves on the top, each of the grooves has a shield;

the length adjustable pole has a base at the bottom, and a front pole at the front; the length of the front pole can be adjusted corresponding to the base;

the rope goes into one of the grooves at the top of the disk, and comes out of the other; and the top of the length adjustable pole is fastened to the hole of the flange at the disk bottom, while the base of the length adjustable pole is fastened to the floor of the boat; the two ends of the rope go through the disk and are then held to a bow and stern, respectively.

2. The tie-down kit for supporting a boat cover according to claim 1, wherein the two grooves at the top of the disk cross each other.

* * * * *